US011578544B2

(12) United States Patent
Whitfill et al.

(10) Patent No.: US 11,578,544 B2
(45) Date of Patent: Feb. 14, 2023

(54) MIXING PROCESS AND DELIVERY OF LOST CIRCULATION SLURRIES

(71) Applicant: Halliburton Energy Services, Inc., Houston, TX (US)

(72) Inventors: Donald Whitfill, Kingwood, TX (US); Jason T. Scorsone, Lafayette, LA (US); Sharath Savari, Boduppal (IN); Reem Mohammed Alburaikan, Al Khobar (SA); Waseem Abdulrazzaq, Al Khobar (SA); Carl Eduard Albrecht, Stafford, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 536 days.

(21) Appl. No.: 16/475,846

(22) PCT Filed: Dec. 27, 2017

(86) PCT No.: PCT/US2017/068519
§ 371 (c)(1),
(2) Date: Jul. 3, 2019

(87) PCT Pub. No.: WO2018/160264
PCT Pub. Date: Sep. 7, 2018

(65) Prior Publication Data

US 2020/0157894 A1 May 21, 2020

Related U.S. Application Data

(60) Provisional application No. 62/466,648, filed on Mar. 3, 2017.

(51) Int. Cl.
*E21B 21/06* (2006.01)
*B01F 27/808* (2022.01)
*B01F 35/71* (2022.01)

(52) U.S. Cl.
CPC ..... *E21B 21/062* (2013.01); *B01F 27/808* (2022.01); *B01F 35/7176* (2022.01)

(58) Field of Classification Search
CPC ..... E21B 21/062; B01F 35/176; B01F 27/808
See application file for complete search history.

(56) References Cited

U.S. PATENT DOCUMENTS

2006/0122071 A1 6/2006 Reddy et al.
2013/0000916 A1 1/2013 Li
(Continued)

FOREIGN PATENT DOCUMENTS

WO 2018160264 A1 9/2018

*Primary Examiner* — Crystal J. Lee
(74) *Attorney, Agent, or Firm* — Thomas Rooney; Parker Justiss, P.C.

(57) ABSTRACT

This disclosure provides a pre-mixed lost circulation treatment that can be pre-mixed ahead of time at a plant and delivered to a drilling site in one or more transport containers because the pre-mixture having a shelf life of at least one month and possibly longer. Because the components of the lost circulation treatment are mixed at a controlled mix site, the consistency of the lost circulation treatment is improved and can be better maintained from one lost circulation treatment to another. Further, one or more of the components of the pre-mixed treatment can be placed in a portable tote container that can be quickly and easily transported to the drilling site upon demand, or the tote can be delivered to the drilling site before a lost circulation zone is actually encountered.

23 Claims, 4 Drawing Sheets

(56) References Cited

U.S. PATENT DOCUMENTS

| | | | | |
|---|---|---|---|---|
| 2013/0130942 | A1* | 5/2013 | Dobson, Jr. | C09K 8/035<br>507/116 |
| 2014/0190696 | A1* | 7/2014 | Iverson | E21B 33/13<br>166/293 |
| 2016/0222274 | A1* | 8/2016 | Hoskins | C09K 8/502 |
| 2016/0312551 | A1* | 10/2016 | Rowe | E21B 47/11 |
| 2017/0009123 | A1* | 1/2017 | Ballew | B01F 7/00133 |

* cited by examiner

MIXING PROCESS AND DELIVERY OF LOST CIRCULATION SLURRIES

CROSS-REFERENCE TO RELATED APPLICATION

This application is the National Stage of, and therefore claims the benefit of, International Application No. PCT/US2017/068519 filed on Dec. 27, 2017, entitled "MIXING PROCESS AND DELIVERY OF LOST CIRCULATION SLURRIES," which was published in English under International Publication Number WO 2018/160264 on Sep. 7, 2018, and has a priority date of Mar. 3, 2017, based on Provisional Application No. 62/466,648. Both of the above applications are commonly assigned with this National Stage application and are incorporated herein by reference in their entirety.

BACKGROUND

Natural resources such as gas, oil, and water residing in a subterranean formation or zone are usually recovered by drilling a wellbore down to the subterranean formation while circulating a drilling fluid in the wellbore. On occasion, highly porous or fractured zones are encountered while drilling, causing a sudden loss in the drilling fluid column and are referred to as lost circulation zones. When a lost circulation zone is encountered, it can often lead to a rapid depletion of the drilling fluid (e.g., mud) column in the wellbore as the drilling fluid rapidly flows into the lost circulation zone. Such events can be critical to the integrity of the wellbore, and if this problem is not quickly controlled, the well can be "lost," for example, due to stuck drill pipe that can be very difficult or impossible to retrieve. When a lost circulation zone is encountered, lost circulation fluids, which are prepared at the drilling site are circulated down hole in an attempt to seal the lost circulation zone and prevent further drilling fluid column loss.

BRIEF DESCRIPTION OF THE DRAWINGS

For a detailed description of the preferred embodiments of the invention, reference will now be made to the accompanying drawings in which.

DETAILED DESCRIPTION

As discussed above, in certain formations, a lost circulation zone may be encountered, and when that happens, time is of the essence in not only addressing the lost circulation problem, but also in reducing costly rig time required to address that problem. Currently, the various components that make up the lost circulation zone are delivered to and mixed at the drilling site as requested, or the components may be individually delivered beforehand, as a precautionary measure, to be on location in anticipation that a lost circulation zone might be encountered based on the known geology of the area. In either of these instances, valuable time is used in ordering, as the case may be, mixing the lost circulation slurry on site, and pumping the slurry downhole. Often, several hours are required to adequately mix the components into a non-aqueous (oil-based) solution, thereby running up rig time costs and increasing the possibility of damage to the well bore. Additionally, because each rig crew is different and may have differing amounts of experience, the consistency of the lost circulation slurry can vary from one drilling site to another, which can lead to an over-use of lost circulation components, or the inconsistency may result in an ineffective slurry.

The different embodiments of this disclosure provide a unique methodology and system for addressing the above-noted problems and disadvantages of current practices in addressing lost circulation zones encountered during the drilling of a well. Embodiments of this disclosure provide a pre-mixed lost circulation treatment that can be mixed at a plant and delivered to the drilling site. Because the base portion of the components of the lost circulation treatment are mixed at a controlled mix site, such as a mud plant, the consistency of the lost circulation treatment is improved and can be better maintained from one lost circulation treatment to another. Further, in one embodiment, the base components of the pre-mixed treatment can be placed in a portable tote container that can be quickly and easily transported to the drilling site upon demand, or the tote can be delivered to the drilling site before a lost circulation zone is actually encountered, as a precautionary measure. It has been unexpectedly found that the pre-mixed state of the base mixture has a viable commercial shelf life that allows it to be stored in a pre-mixed state for quick delivery to a drilling site while maintaining its reactivity, that is, the pre-mixed components are as effective in use as if the components were mixed at the well site. This present realization, which has heretofore been unrecognized, allows the utility of keeping a base portion of the components of the lost circulation mixture in a pre-mixed state for up to at least one month and possibly longer, thereby providing a readily available pre-mixed components of a lost circulation treatment.

Figure 1:
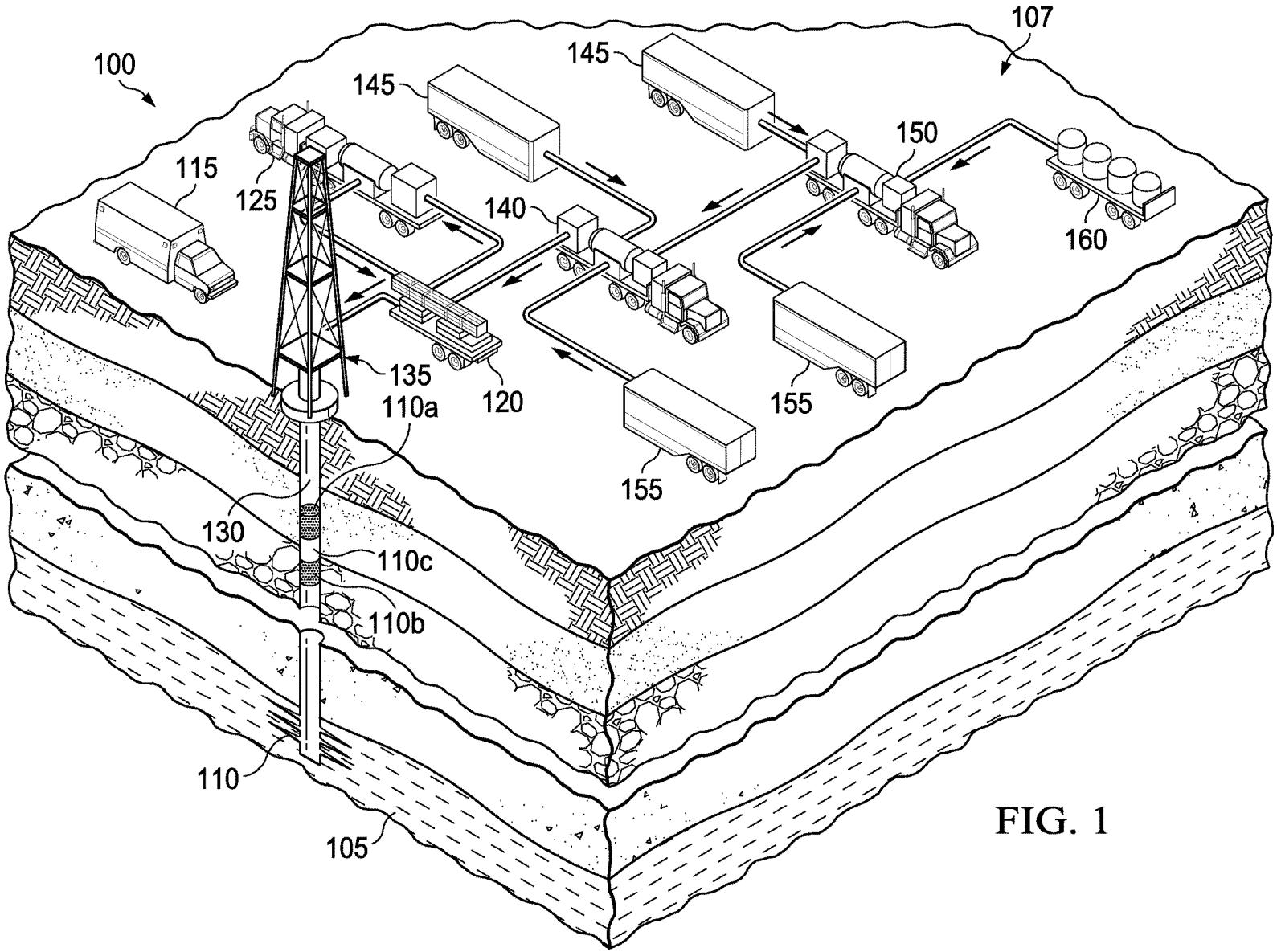
FIG. 1 is a view of a drilling site.

FIG. 1 illustrates a typical well system 100 in which the method and related systems of this disclosure may be used. The well system 100 is considered a target well, because it may be a well to which the lost circulation treatment is to be delivered. Once a lost circulation zone 105 is encountered, a typical cementing/pumping system 107 can be used to pump lost circulation slurry down to the lost circulation zone 105 through the end of drill string 110 to reduce or stop fluid loss. Such well systems 100 include, among other units, an operations control unit 115, a manifold unit 120, a pump 125, a wellbore 130 over which resides the drilling rig 135. The cementing/pumping system 107 comprises a slurry blender system 140 where the lost circulation slurry is dispensed directly from the portable totes and combined with the other lost circulation components and pumped downhole in the form of one or more pills 110*a*, 110*b* that are separated by a spacer 110*c*. As used in the drilling industry, a "pill" is a relatively small quantity (e.g., less than 200 bbls) of a special blend of drilling fluid to accomplish a specific task that the regular drilling fluid cannot perform, such as a lost circulation material pill for plugging a lost circulation zone. The slurry blender system 140 comprises one or more of the following: fluid tanks 145, a blender 150, other storage tanks 155, and portable transport containers 160, for example typical totes or other bulk containers or packaging, that contain pre-mixed lost circulation components as described in various embodiments below. The contents of the transport containers 160 is couplable (i.e. can be coupled to by conduits or dispensed directly into) to the slurry blender system 140.

As seen in the embodiment of FIG. 1, the portable transport containers 160 include two or more containers that can be easily be transported to the drilling site. The contents of the transport container placed into the blender system 150 by system pumps that can be used to pump the pre-mixed lost circulation slurry to the slurry blender system 150, which in turn, allows the lost circulation to be combined with other lost circulation components and be pumped downhole to the lost circulation zone 105 in the form of "pills," as described below, thereby, reducing or preferably stopping the loss of drilling fluid into the lost circulation zone 105.

Figure 2:
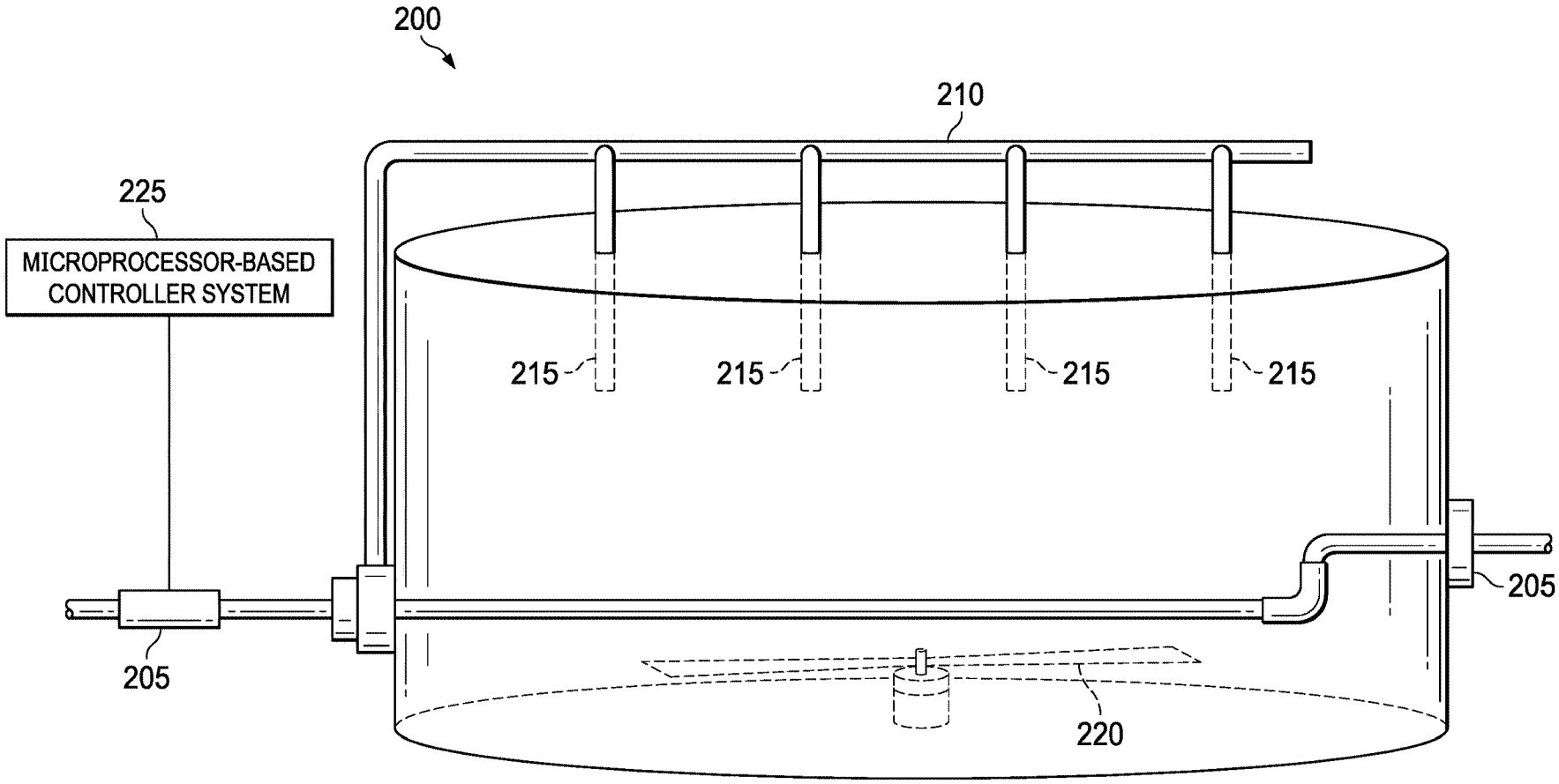
FIG. 2 is a view of mixing tank of a mixing plant.

FIG. 2 is a general schematic view of a typical mixing tank 200, such as those currently found in mud mixing plants that may be a dedicated, centralized plant at which lost circulation slurries may be accurately pre-mixed and stored for immediate transport to a drilling site. Though only one such mixing tank 200 is shown, it should be understood that a mud mixing plant has a plurality of tanks similar to the one shown and includes pump and conduit systems to move the materials through the mixing plant.

In the illustrated embodiment, the mixing tank 200 includes, among other components, pumps 205 and a fluid conduit system 210 for transporting liquids to and from the mixing tank 200. The mixing tank 200 may include one or more mixing guns 215 located within the mixing tank 200 and one or more agitators 220 for stirring the fluids to prevent contents from precipitating. The mixing guns are often located at the corners of the tank's top, and configured to spray high-pressed solids to prevent the lost circulation fluids in the corner of the mixing tank 200 from precipitating, while the agitators 220 are located in the middle of the mixing tank 200.

The mixing plant may also include a known computer or microprocessor controller system 225, including memory, etc., that can be used to precisely control the amounts of the various components of the lost circulation slurry and the mixing times needed for adequately mixing the materials together or causing them to go into solution. Because the preparation of the lost circulation treatment can be done prior to any present downhole emergency, adequate time can be used to accurately mix the base mixture of the lost circulation treatment.

In an embodiment, the computer system 225 may include a processor, computer-readable storage media and a storage device, and an input/output device. Each of these components may be interconnected, for example, using a system bus. The processor may process instructions for execution within the computer system. In some embodiments, the processor is a single-threaded processor, a multi-threaded processor, a system on a chip, a special purpose logic circuitry, e.g., an FPGA (field programmable gate array) or an ASIC (application specific integrated circuit), or another type of processor. The processor may be executable on a computer readable program code stored in the memory or on the storage device. The memory and the storage device include non-transitory media such as random access memory (RAM) devices, read only memory (ROM) devices, optical devices (e.g., CDs or DVDs), semiconductor memory devices (e.g., EPROM, EEPROM, flash memory devices, and others), magnetic disks (e.g., internal hard disks, removable disks, and others), and magneto-optical disks. The input/output device may perform input/output operations for the timing and fluid flows associated with the mixing tank 200. The computer system may process the input data and provide the processing results using the input/output device.

In some embodiments, the input/output device can include one or more network interface devices, e.g., an Ethernet card; a serial communication device, e.g., an RS-232 port; and/or a wireless interface device, e.g., an 802.11 card, a 3G wireless modem, or a 4G wireless modem. In some embodiments, the input/output device can include driver devices configured to receive input data and send output data to other input/output devices, including, for example, a keyboard, a pointing device (e.g., a mouse, a trackball, a tablet, a touch sensitive screen, or another type of pointing device), a printer, and display devices (e.g., a monitor, or another type of display device) for displaying information to a user. Other kinds of devices can be used to provide for interaction with the user as well; for example, feedback provided to the user can be any form of sensory feedback, e.g., visual feedback, auditory feedback, or tactile feedback; and input from the user can be received in any form, including acoustic, speech, or tactile input. In some embodiments, mobile computing devices, mobile communication devices, and other devices can be used.

Additionally, the computer system may include a single processing system, or may be a part of multiple processing systems that operate in proximity or generally remote from each other and typically interact through a communication network. Examples of communication networks include a local area network ("LAN") and a wide area network ("WAN"), an inter-network (e.g., the Internet), a network comprising a satellite link, and peer-to-peer networks (e.g., ad hoc peer-to-peer networks). A relationship of client and server may arise by virtue of computer programs running on the respective processing systems and having a client-server relationship to each other.

Figure 3:
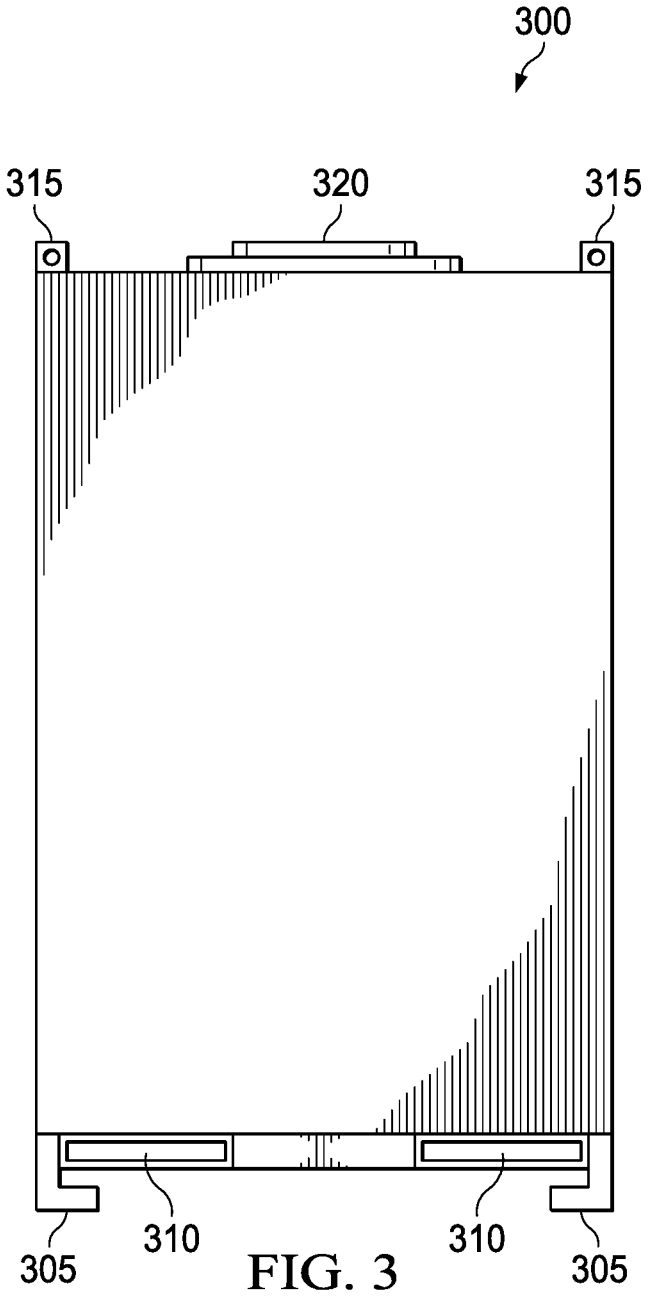
FIG. 3 is a view of a transport container for transporting a lost circulation material to a drilling site.

FIG. 3 illustrates an embodiment of a transport container 300, in which the pre-mixed lost circulation base mixture may be stored. An examples of the transport container 300 include an intermediate bulk container (IBC), IBC tote, or pallet tank that is a reusable industrial container designed for the transport and storage of bulk liquid and granulated substances, such as chemicals, solvents, etc. Intermediate bulk containers are stackable containers mounted on a pallet designed to be moved using a forklift or a pallet jack. IBCs have a volume range that is situated between drums and tanks, hence the term "intermediate". The most common sizes are 1,040 liters or 275 U.S. gallons or 229 imperial gallons and 1,250 liters or 330 U.S. gallons or 275 imperial gallons (the 1040 liter IBCs are often listed as being 1000 liters). Cube-shaped IBCs give a particularly good utilization of storage capacity compared to palletized drums. One 275 gallon IBC is equivalent to five 55-US-gallon (208 L; 46 imp gal) drums, and a 330-gallon IBC is equivalent to six 55 gallon drums. The most common IBC is the one-time use plastic composite IBC-a white/translucent plastic container (typically polyethylene) housed within a tubular galvanized iron cage that is attached to a pallet. IBCs can be made from many materials depending upon the needs of the shipper and the legal requirements that must be met. In addition to the plastic composite IBC, intermediate bulk containers are also made of fiberboard, wood, heavy gauge plastic, aluminum, carbon steel, galvanized iron or sheet metal. Heavy-gauge plastic IBCs are made of reinforced plastic that requires no steel cage; they have a pallet molded into the bottom so the entire unit is a single piece.

Folding IBCs are also made of heavy plastic. Their sides fold inward when the unit is empty allowing the IBC to collapse into a much smaller package for return shipment or storage. Flexible intermediate bulk containers, made of woven polyethylene or polypropylene bags, are designed for storing or transporting dry, flowable products, such as sand, fertilizer, and plastic granules. Almost all rigid IBCs are designed so they can be stacked vertically one atop the other using a forklift. Most have a built-in tap (valve, spigot, or faucet) at the base of the container to which hoses can be attached, or through which the contents can be poured into smaller containers. Other examples of the transport containers may be other types of easily transported bulk containers or even in bag, in those instances where the lost circulation component is in dry powder form.

The transport container 300 is small in comparison to other storage tanks, such as frac tanks. The smaller size allows them to be compactly stored and quickly moved with smaller moving equipment, such as fork lifts or wenches, if desired. As such, the transport container 300 may have the volumes mentioned above. In one embodiment, the transport container 300 includes support feet 305 that keeps it elevated about a supporting surface. The transport container 300 may also include fork lift runners 310 located at the bottom of the transport container 300 that are designed to accommodate fork lift blades that allow the transport container 300 to be lifted and placed on a transport vehicle or in a designated storage area. Alternatively or in addition to the fork lift runner 310, the transport container 300 may also include lifting eyes 315 located at least on two diagonally opposing corners of the transport container 300. In other embodiments where the transport container 300 is rectangular in shape, a lifting eye may be located at each of its corners or one eye may be located in the center of the transport container 300.

The lifting eyes 315 are designed to accommodate a lifting hook attached to a cable that is attached to a lifting crane or wench, so that the transport container 300 can be lifted and placed onto a transport vehicle or in a designated storage area. The transport container 300 also includes an access door 320 located on the transport container's 300 top surface that keeps the contents of the transport container 300 sealed from the surrounding environment. The transport container's 300 overall weight and size are designed to allow it to be easily moved and transported to a drilling site. For example, in one embodiment, the transport container 300 is sized to hold 5 to 20 bbls (barrels) of a pre-mixed lost circulation mixture. However, other embodiments provide sizes above and below the stated range, as long as the transport container 300 has the degree of portability that is required for minimized transport and storage efforts as opposed to transport and storages efforts associated with larger containers, such as frac tanks and cementing systems.

Once delivered to the drilling site, the pre-mixed lost circulation mixture can be pumped directly from the transport container(s) 300 to the previously described cementing/pumping system. Though the illustrated embodiment shows the transport container 300 to have a rectangular shape, it is not limited to this shape, but in other embodiments, it may be of another shape, such as a cylindrical shape. Thus, the transport container 300 provides a way to deliver a pre-mixed lost circulation material quickly and easily to a drilling site.

Because the lost circulation mixture is primarily mixed at a dedicated plant, the consistency of the lost circulation mixture is improved and expensive rig time can be reduced because the components are already mixed together, thereby eliminating the time it takes, in some instances, to mix the components sufficiently to get them into solution. For example, as explained below, in some formulations, it may take several hours (e.g., up to four hours in some cases) to get certain components of the lost circulation mixture into solution, such occurs when dissolving a resin into an oil-base non-aqueous system. This is valuable rig time that is saved by having the lost circulation mixture delivered to the drilling site in a pre-mixed state.

One embodiment of this disclosure provides a process for preparing a pre-mixed lost circulation treatment for delivery to a drilling site. This embodiment comprises placing metal salt into a mixing chamber, placing silicate material and a viscosifier into the mixing chamber, mixing the metal salt, the silicate material and the viscosifier in the mixing chamber, thereby forming a base mixture. The base mixture is then placed in a first transport container, as described above to be delivered to the drilling site. Typically, the mixing chamber will be remote to the drilling site. As used herein and in the claims, "remote" is meant to convey that it is not part of the drilling site or rig setup and may be a distance from the actual drilling site, such that the transport container has to be delivered to the location of the drilling site.

One aspect of the above-described embodiment is directed to an aqueous based treatment where during the mixing, water is placed in the mixing chamber along with the base mixture to obtain an aqueous base mixture that is placed in the first transport container. Another variation of this embodiment includes mixing metal oxide with a viscosified aqueous phase carrier to obtain an aqueous metal oxide mixture that is placed in a second transport. The base mixture and the aqueous metal oxide mixture remain separate from each other until both containers are transported to the drilling site, at which point they are dispensed into a drilling site mixing system. Once at the drilling site, the aqueous base mixture and the aqueous metal oxide mixture are removed from their respective transport containers and pumped down hole through the drill string as separate pills with the aqueous based mixture forming one pill and the metal oxide mixture forming the second pill. The pills are isolated from each other by spacers to keep them from reacting with each other until they have exited the bottom hole assembly of the drill string, at which point they are mixed with water that activates the lost circulation.

In the embodiments discussed herein, the metal salt may be a magnesium chloride ($MgCl_2$), for example magnesium chloride hexahydrate ($MgCl_2 \cdot 6H_2O$). $MgCl_2$ is well known and available from a wide variety of sources. For example, a suitable $MgCl_2$ for use in this disclosure is C-TEK™, which is commercially available from Halliburton Energy Services. In another embodiment, the metal salt may be zinc chloride ($ZnCl_2$). The grain size of the metal salt may vary from one embodiment to another, however, in one embodiment, the metal salt is a fine grain material of particles with the particles having a size of less than about 10 microns. This particle size has proven to provide good reactivity.

The silicate material may be of various compositions. For example, in one embodiment, the silicate material is attapulgite clay. Attapulgite is a colloidal clay mineral composed primarily of magnesium silicate, silica, and crystalline quartz. In salt water, attapulgite can swell to approximately 10 times its original volume and is well suited for saltwater applications. It is used for decreasing slurry weight and increasing slurry volume and is effective at temperatures up to 500° F. (260° C.). Attapulgite is compatible with slurries containing fibrous, granular, and flake-type lost-circulation materials. It is easily obtained and can provide an effective lost-circulation material when mixed with other common oilfield materials and is cost effective when compared to other lost-circulation materials. This material can be effective in regular and cavernous lost-circulation zones and where drilling with fibrous, granular, or flake materials has been ineffective.

In other embodiments, the silicate material may be bentonite clay. Bentonite is a colloidal clay mineral. It may also contain accessory minerals, such as quartz, feldspar, and calcite. In fresh water, bentonite swells to approximately 10 times its original volume. Bentonite is used for decreasing slurry weight and increasing slurry volume. In bentonite-cement diesel-oil (BCDO) and bentonite diesel-oil (BDO) slurries, bentonite forms a thick, paste-like material that helps prevent lost circulation, and it is compatible with slurries containing fibrous, granular, and flake-type lost-circulation materials. Bentonite is easily obtained and can be an effective lost-circulation material when mixed with other common oilfield materials and is cost effective. Bentonite can be effective in regular and cavernous lost-circulation zones and where drilling with fibrous, granular, or flake materials has been ineffective. In still other embodiments, the silicate material may be sepiolite clay, or rock wool.

In one embodiment, the metal oxide is magnesium oxide (MgO) or zinc oxide (ZnO). In an embodiment where MgO is used, the MgO is a "burned" MgO, obtained from the calcination of the $Mg(OH)_2$. Three basic grades of burned MgO are typically produced with the differences between each grade related to the degree of reactivity remaining after being exposed to a range of extremely high temperatures. The original magnesium hydroxide particle is usually a large and loosely bonded particle. Exposure to thermal degradation by calcination causes the $Mg(OH)_2$ to alter its structure so that the surface pores are slowly filled in while the particle edges become more rounded. This results in MgO with varying degrees of crystallinity and consequently varying degrees of reactivity. When the MgO is produced by calcining to temperatures ranging between 1500° C.-2000° C. the MgO is referred to as "dead-burned," because the majority of the reactivity has been eliminated. Dead-burned MgO has the highest degree of crystallinity of the three grades of burned MgO. An example of a dead-burned MgO includes without limitation THERMATEK™ HT rigid setting fluid which is commercially available from Halliburton Energy Services.

A second type of MgO produced by calcining at temperatures ranging from 1000° C.-1500° C. is termed "hard-burned" and displays an intermediate crystallinity and reactivity when compared to the other two grades of burned MgO. An example of a hard-burned MgO includes without limitation THERMATEK™ LT rigid setting fluid which is commercially available from Halliburton Energy Services.

The third grade, light burned, of MgO is produced by calcining at temperatures ranging from 700° C.-1000° C. and is termed "light-burned" or "caustic" magnesia. Light-burned MgO is characterized by a high surface area, a low crystallinity and a high degree of reactivity when compared to the other grades of burned MgO. Though any of these grades may be used, in one embodiment, the MgO is a hard-burned MgO that has an acetic acid test reactivity of less than about 47 seconds, which gives a good reaction rate when combined with the base mixture of the metal salt and the silicate material at the drilling site.

An acetic acid test was conducted on a hard-burnded MgO to determine its reactivity. Seven drops of Fann Phenolphthalein were added to 300 grams of warm de-ionized water (about 28° C.). About 5 grams of MgO was quickly (approximately 5 minutes) stirred into the warm water and Phenolphthalein mixture. After 10 seconds from the addition of the MgO, 100 ml of 1.00N acetic acid was added to the water, Phenolphthalein, and MgO mixture. The number of seconds was measured from the point of the addition of the acetic acids until the mixture turned a pink color. The number of seconds that it took for the mixture to turn the pink color after the addition of the acetic acid solution provided the reactivity rate of the MgO, which in the stated example was 47 seconds, indicating a high reactivity.

The combination of the metal salt, silicate material and MgO forms a type of cement commonly referred to as a Sorel cement, which is suitable for various wellbore servicing applications such as for example conformance control where the cements are used to control the influx of water into a subterranean formation.

In one embodiment the lost circulation treatment is an aqueous-based system in which the metal salt may be magnesium chloride hexahydrate ($MgCl_2 \cdot 6H_2O$) or zinc chloride ($ZnCl_2$). In such alternative embodiments, the ($MgCl_2$) or ($ZnCl_2$) and silicate material are mixed with a viscosifier, such as those described below, and placed in a first tote to form a base mixture and the metal oxide is mixed with a viscosified aqueous phase (e.g., a viscosifier, as noted below, and water) to form an aqueous metal oxide mixture that is placed in a separate, second tote. Once at the drilling site, the aqueous base mixture and aqueous metal oxide mixture are removed from their respective transport containers and pumped down hole through the drill string as separate pills with the aqueous based mixture forming one pill and the aqueous oxide mixture forming a second pill. The pills are isolated from each other by spacers to keep them from reacting with each other until they exited the bottom hole assembly of the drill string, at which point they mix with water that activates the components to form the lost circulation treatment.

In yet other embodiments the lost circulation treatment is an aqueous-based system in which the metal salt may be magnesium sulfate heptahydrate ($MgSO_4 \cdot 7H_2O$) or magnesium phosphate ($Mg3(PO_4)_2$). In such alternative embodiments, the ($MgSO_4 \cdot 7H_2O$) or ($Mg3(PO_4)_2$) and silicate material are mixed and placed in a first tote to form an aqueous base mixture and the metal oxide is mixed with a viscosified aqueous mixture (e.g., viscosifier, as those noted below, mixed with water) to form an aqueous metal oxide mixture that is placed in a separate, second tote. Once at the drilling site, the aqueous base mixture and aqueous metal oxide mixture are removed from their respective transport containers and pumped down hole through the drill string as separate pills with the aqueous based mixture forming one pill and the aqueous oxide mixture forming a second pill. The pills are isolated from each other by spacers to keep them from reacting with each other until they exit the bottom hole assembly of the drill string, at which point they mix with water that activates the components to form the lost circulation treatment.

Magnesium sulfate heptahydrate has been shown to have increased performance over other metal salts, such as $MgCl_2$. For example, tests have shown that $MgSO_4$ has a 20 second increased reaction rate, 70% increase in compressive strength, 400% increase in differential pressure, an increase in the pumpability rate, and improved solubility in HCl. Further, the shelf life of the mixture is comparable to that of $MgCl_2$, lasting up to at least one and possibly longer.

In another embodiment, the lost circulation treatment is a non-aqueous-based system. In this embodiment, a base oil is placed in the mixing chamber and a viscosifying agent is dissolved into the base oil to form a liquid mixture. The dissolution of the viscosifying agent into the base oil can take up to four hours. Thus, this particular embodiment benefits further from being pre-mixed at a mixing plant due to the length of time it takes to dissolve the viscosifying agent into solution. Once the viscosifying agent is in solution, the silicate material, such as attapulgite clay, is added and thoroughly mixed into the liquid to form a mixture. The metal salt, such as $MgCl_2$, is added and thoroughly mixed into the mixture, which forms the base mixture and placed in a first transport container, such as a tote. In one aspect of this embodiment, the metal oxide, such as MgO, is a magnesium oxide mixture aqueous phase that is placed in a second transport container. The non-aqueous fluid prevents a reaction between the metal salt and the silicate material from occurring. Once at the drilling site, the aqueous base mixture and aqueous metal oxide mixture are removed from their respective transport containers and pumped down hole through the drill string as separate pills with the aqueous based mixture forming one pill and the aqueous oxide mixture forming a second pill. The pills are isolated from each other by spacers to keep them from reacting with each other until they exit the bottom hole assembly of the drill string, at which point they mix with water that activates the components to form the lost circulation treatment.

In another embodiment, the MgO may be in dry powder, that is transported to the drill well site in a second transport container and that can be added in bulk into the drilling string with the base mixture. The base oil prevents reaction between the two until they are mixed with water as they exit the end of the drill string, or they may be placed into the drill string in separate pills as described above regarding other embodiments.

Figure 4:
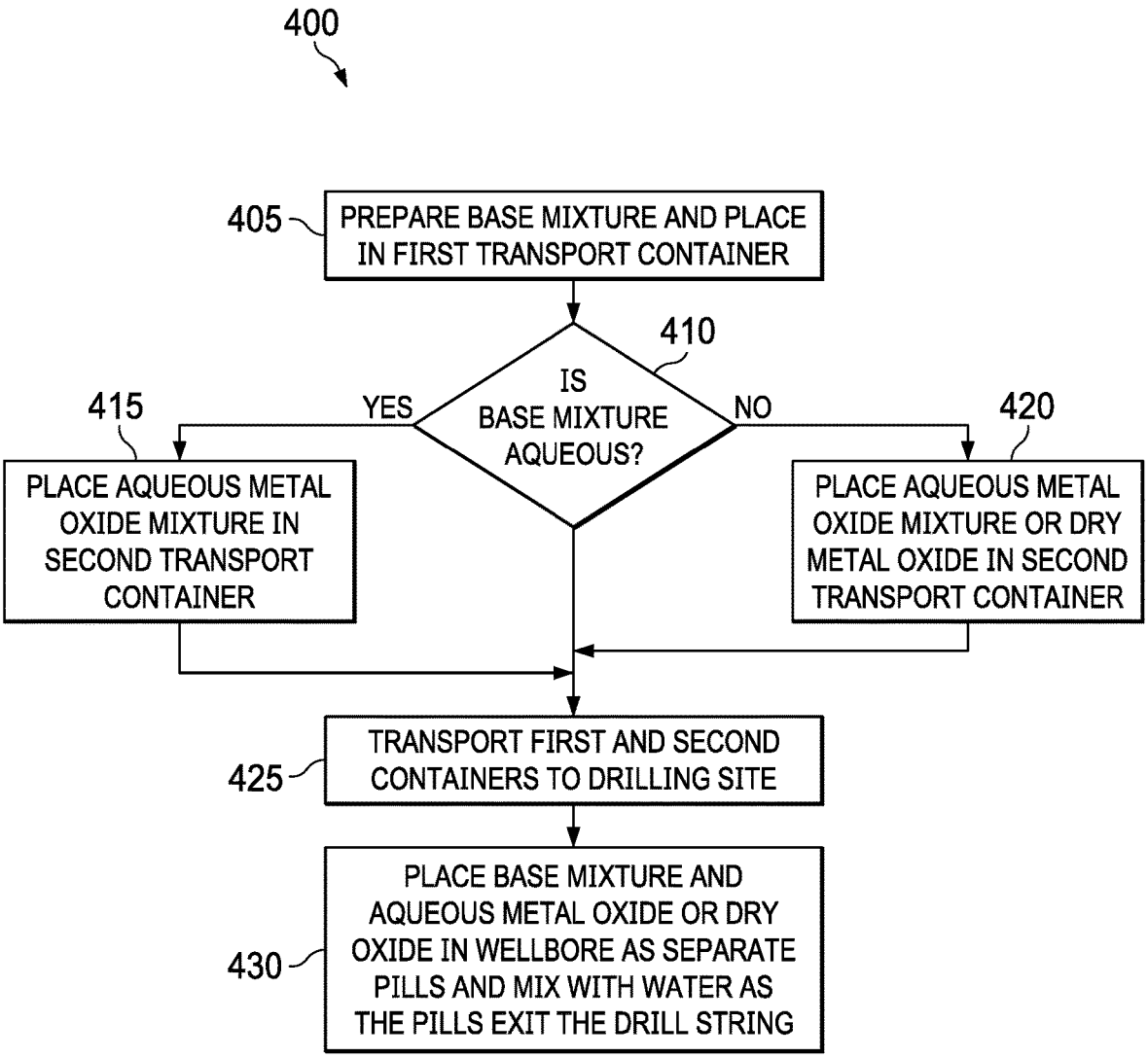
FIG. 4 is a flow chart illustrating basic steps of two embodiments.

FIG. 4 illustrates a flow process 400 involving different embodiments as described above. In a step 405, the base mixture is prepared in accordance with the embodiments described above and placed in a first transport container. In step 410, if the base mixture is aqueous, the aqueous metal oxide mixture is prepared and placed in a second transport container in step 415. In step 420, if the base mixture is aqueous, there is an option to place either the aqueous metal oxide mixture or a dry metal oxide powder in the second transport container. In step 425, the first and second transport container are delivered to the drilling site. In step 430, the base mixture and the metal oxide, in one embodiment, may be pumped down the drill string as separate pill and mixed with water as the pill exit the drill string.

In embodiments discussed herein, the non-aqueous fluid is an isomerized olefin-based fluid, such as oil, diesel, or synthetic oils. Non-limiting examples of the viscosifying agent include styrene-isoprene copolymers, hydrogenated styrene-isoprene block copolymers, styrene ethylene/propylene block copolymers, styrene isobutylene copolymers, styrene butadiene copolymers, polybutylene and polystyrene, polyethylene-propylene copolymers, include copolymers and block copolymers such as poly(styrene-co-isoprene), hydrogenated block-copoly(styrene/isoprene), block-copoly(styrene/ethylene/propylene), poly(styrene-co-isobutylene), copolymer(styrene-co-butadiene), polybutylene, polystyrene, copolymer(polyethylene-co-propylene), and combinations of two or more thereof. These oil soluble resins should have a molecular weight in tile range of from about 40,000 to about 100,000. In an embodiment, however, block copolymers are used, examples of which include but are not limited to block-copoly(styrene/ethylene/propylene), hydrogenated block-copoly(styrene/isoprene) and block-copoly(styrene/butadiene). In yet other embodiments, the viscosifying agent is hydrogenated (styrene-isoprene) copolymers and styrene-butadiene copolymers examples of which include but are not limited to materials sold under the trademarks "BARARESIN VIS"® (a trademark of Baroid Corporation).

As noted above, once the mixing is completed, the non-aqueous base mixture can be placed in a tote and may be stored for up to at least one and possibly longer. It is believed that shelf times of greater than one month are contemplated by the various embodiments described herein.

In some embodiments, other additives may be added to the base mixtures provided above as the drilling site to improve the efficacy of the lost circulation treatment. Examples of such additives include but are not limited to salts, accelerants, set retarders or inhibitors, defoamers, fluid loss agents, weighting materials, dispersants, vitrified shale, formation conditioning agents, or combinations thereof. Other mechanical property modifying additives, for example, carbon fibers, glass fibers, metal fibers, minerals fibers, and the like can be added to further modify the mechanical properties. These additives may be included singularly or in combination as the drilling site. Methods for introducing these additives and their effective amounts are known to one of ordinary skill in the art.

EXAMPLE I

An Aqueous-based trial lost circulation sample was prepared using 284.55 grams of water, 18 grams of attapulgite clay, 60.75 grams of $MgSO_4 \cdot 7H_2O$ mixed together and stored in a first container. In a second container, 142.28 grams of water, 3 grams of attapulgite clay and 80.6 grams of MgO were mixed together and demonstrated an acetic reactivity test of less than 47 seconds, thereby indicating good reactivity for a period ranging from one or possibly longer. This sample is illustrative of one embodiment only and it should be understood that other embodiments may contain different amounts of the components from those of the sample and additional components. Conversion to a full scale well application can easily be made by those skilled in the art.

EXAMPLE II

Various trial lost circulation samples were prepared for a storage test using 274.4 ml of base oil, a 100% isomerized olefin-based fluid, 7 grams of BARARESIN VIS® (a trademark of Baroid Corporation), 52 grams of attapulgite clay, 48 grams of fine grained (less than 10 micron particle size) $MgSO_4$ and 70 grams of MgO that were mixed in the order just presented. The MgO were added as dry additive on the pulled sample. It took up to 10-15 minutes in the lab to mix the BARARESIN VIS to obtain a homogeneous mixture, after which the other above-stated components were added. However, it is expected that would be equivalent to 4 hours in mixing plant. Trial samples were stored at 40° C. to 120° C. (Testing temperature 120° F.=48.89° C.), pulled sample (274.4 ml of base oil, a 100% isomerized olefin-based fluid, 7 grams of BARARESIN VIS® (a trademark of Baroid Corporation), 52 grams of attapulgite clay, 48 grams $MgSO_4$) tested for periods ranging from 1 week to 12 weeks (tested form 1-4 weeks) and in each instance the pre-mixed lost circulation samples retained good reactivity when mixed with water after adding 70 grams MgO. This sample is illustrative of one embodiment only and it should be understood that other embodiments may contain different amounts of the components from those of the sample and may include other components. Conversion to a full scale well application can easily be made by those skilled in the art.

EXAMPLE III

Various trial lost circulation samples were prepared for a storage test using 276.5 ml of base oil, a 100% isomerized olefin-based fluid, 7 grams of BARARESIN VIS® (a trademark of Baroid Corporation), 52 grams of attapulgite clay, 40 grams of fine grained (less than 10 micron particle size) $MgCl_2$ and 70 grams of MgO that were mixed in the order just presented. It took up to 4 hours to mix the BARARESIN VIS® (a trademark of Baroid Corporation) into the base oil, after which the other above-stated components were added. Trial samples were stored at 40° C. to 120° C., pulled and tested for periods ranging from 1 week to 12 weeks and in each instance the pre-mixed lost circulation samples retained good reactivity when mixed with water. This sample is illustrative of one embodiment only and it should be understood that other embodiments may contain different amounts of the components from those of the sample and additional components. Conversion to a full scale well application can easily be made by those skilled in the art.

The invention having been generally described, the following embodiments are given by way of illustration and are not intended to limit the specification of the claims in any manner.

Embodiments herein comprise:

A process for preparing a pre-mixed lost circulation treatment for delivery to a drilling site, comprising: placing metal salt into a mixing chamber; placing silicate material into the mixing chamber; placing a viscosifer in the mixing chamber; mixing the metal salt, the silicate material, and the viscosifier in the mixing chamber, thereby forming a base mixture; and placing the base mixture into a first transport container configured to be delivered to a drilling site.

Another embodiment is directed to a pre-mixed lost circulation treatment delivery system, comprising: a mixing plant located away from a target drilling site to which a lost circulation treatment is deliverable. The mixing plant comprising: a mixing chamber and associated pumps and conduit systems for mixing lost circulation materials therein; a first transport container configured to be delivered to a drilling site; a base lost circulation mixture located within the first transport container, comprising a mixture of; a metal salt; a silicate material; and a viscosifier; and a second transport container having metal oxide located therein.

Each of the foregoing embodiments may comprise one or more of the following additional elements singly or in combination, and neither the example embodiments or the following listed elements limit the disclosure, but are provided as examples of the various embodiments covered by the disclosure:

Element 1: wherein mixing further comprises placing water in the mixing chamber and mixing the base mixture with the water to obtain an aqueous base mixture and placing the aqueous base mixture in the first transport container.

Element 2: further comprising mixing metal oxide with viscosified aqueous phase carrier to obtain an aqueous metal oxide mixture and placing the aqueous metal oxide mixture into a second transport container configured to be transported to the drilling site.

Element 3: wherein the metal oxide is magnesium oxide (MgO) or zinc oxide (ZnO).

Element 4: further comprising: transporting the first and second transport containers to the drilling site having an associated drilling site mixing system; transferring the aqueous base mixture from the first transport container into a drilling string as a first pill; transferring the aqueous metal oxide mixture from the second transport container into the drilling string as a second pill; placing a spacer between the first and second pills; and pumping the first and second pills out through an end of the drilling string.

Element 5: wherein the silicate material is attapulgite clay, bentonite clay, sepiolite clay, or rock wool.

Element 6: wherein the metal salt is magnesium chloride hexahydrate ($MgCl_2 \cdot 6H_2O$) or zinc chloride ($ZnCl_2$), and the viscosifier is a copolymer resin.

Element 7: wherein the metal salt is magnesium sulfate heptahydrate ($MgSO_4 \cdot 7H_2O$) or magnesium phosphate ($Mg3(PO_4)_2$), and the viscosifier is a copolymer resin.

Element 8: wherein the base mixture has a reactivity rate when placed in the first transport container and retains the reactivity rate up to at least one month in a pre-mixed state.

Element 9: wherein forming the base mixture further comprises dissolving the metal salt, the silicate, and the viscosifier in a non-aqueous isomerized olefin-based fluid, thereby forming a non-aqueous solution.

Element 10: further comprising placing a metal oxide in a second transport container.

Element 11: transporting the first transport container and the second transport container to the drilling site having an associated drilling site mixing system; transferring the non-aqueous solution from the first transport container into a drilling string; transferring the metal oxide mixture from the second transport container into the drilling string; and pumping the non-aqueous solution and the metal oxide out through the end of the drilling string to form a lost circulation slurry.

Element 12: wherein the silicate material is attapulgite clay, bentonite clay, sepiolite clay, or rock wool, the metal salt is magnesium chloride hexahydrate ($MgCl_2 \cdot 6H_2O$) or zinc chloride ($ZnCl_2$), and the metal oxide is magnesium oxide.

Element 13: wherein the non-aqueous solution, when placed in the transport container, has a reactivity rate and retains that reactivity rate up to at least one month in a pre-mixed state.

Element 14: wherein the metal oxide is an aqueous magnesium oxide mixture.

Element 15: wherein the metal oxide is a dry magnesium oxide powder.

Element 16: wherein the metal salt is magnesium sulfate heptahydrate ($MgSO_4 \cdot 7H_2O$) or magnesium phosphate ($Mg3(PO_4)_2$), the viscosifier is a copolymer resin, and the silicate material is attipulgite clay that are mixed with water to form an aqueous base lost circulation mixture located within the first transport container.

Element 17: wherein the metal salt is magnesium chloride hexahydrate ($MgCl_2 \cdot 6H_2O$), the silicate material is attipulgite clay, and the viscosifier is a copolymer resin that are mixed in a non-aqueous isomerized olefin-based fluid.

Element 18: wherein the base lost circulation mixture has a reactivity rate when placed in the first container and retains the reactivity rate up to at least one month while in the first transport container.

What is claimed is:

1. A process for preparing a pre-mixed lost circulation treatment and delivery to a drilling site, comprising:

placing metal salt into a mixing chamber;

placing silicate material into the mixing chamber;

placing a viscosifier in the mixing chamber;

mixing the metal salt, the silicate material, and the viscosifier in the mixing chamber, thereby forming a base mixture; and placing the base mixture into a first transport container configured to be transported delivered to a drilling site for transfer to a drilling string; and placing metal oxide into a second transport container configured to be transported to the drilling site for transfer to the drilling string.

2. The process of claim 1, wherein the mixing in the mixing chamber further comprises placing water in the mixing chamber and mixing the base mixture with the water to obtain an aqueous base mixture and placing the aqueous base mixture in the first transport container.

3. The process of claim 2, further comprising mixing the metal oxide with viscosified aqueous phase carrier to obtain an aqueous metal oxide mixture and placing the aqueous metal oxide mixture into the second transport container.

4. The process of claim 1, wherein the metal oxide is magnesium oxide (MgO) or zinc oxide (ZnO).

5. The process of claim 3, further comprising:

transporting the first and second transport containers to the drilling site having an associated drilling site mixing system;

transferring the aqueous base mixture from the first transport container into the drilling string as a first pill;

transferring the aqueous metal oxide mixture from the second transport container into the drilling string as a second pill;

placing a spacer between the first and second pills; and pumping the first and second pills out through a bottom hole assembly of the drilling string wherein the base mixture and the metal oxide are isolated from each other by the spacer until exiting the bottom hole assembly of the drilling string.

6. The process of claim 1, wherein the silicate material is attapulgite clay, bentonite clay, sepiolite clay, or rock wool.

7. The process of claim 1, wherein the metal salt is magnesium chloride hexahydrate ($MgCl_2 \cdot 6H_2O$) or zinc chloride ($ZnCl_2$), magnesium sulfate heptahydrate ($MgSO_4 \cdot 7H_2O$) or magnesium phosphate ($Mg_3(PO_4)_2$).

8. The process of claim 1, wherein the base mixture has a reactivity rate when placed in the first transport container and retains the reactivity rate up to at least one month in a pre-mixed state.

9. A process for preparing a pre-mixed lost circulation treatment and delivery to a drilling site, comprising:

placing metal salt into a mixing chamber;

placing silicate material into the mixing chamber;

placing a viscosifier in the mixing chamber;

mixing the metal salt, the silicate material, and the viscosifier with a non-aqueous isomerized olefin-based fluid, thereby forming a non-aqueous solution in the mixing chamber; placing the non-aqueous solution into a first transport container configured to be transported to the drilling site;

placing magnesium oxide into a second transport container configured to be transported to the drilling site the viscosifier is a copolymer resin selected from the group consisting of: styrene-isoprene copolymers, hydrogenated styrene-isoprene block copolymers, styrene ethylene/propylene block copolymers, styrene isobutylene copolymers, styrene butadiene copolymers, polybutylene and polystyrene, polyethylene-propylene copolymers, include copolymers and block copolymers such as poly(styrene-co-isoprene), hydrogenated block- copoly(styrene/isoprene), block-copoly (styrene/ethylene/propylene), poly(styrene-co-isobutylene), copolymer(styrene-co-butadiene), polybutylene, polystyrene, copolymer(polyethylene-co-propylene), and combinations of two or more thereof.

10. The process of claim 9 , wherein the non-aqueous isomerized olefin-based fluid is oil, diesel, or synthetic oil.

11. The process of claim 9, wherein the metal salt is magnesium chloride hexahydrate ($MgCl_2 \cdot 6H_2O$), zinc chloride ($ZnCl_2$), magnesium sulfate heptahydrate ($MgSO_4 \cdot 7H_2O$) or magnesium phosphate ($Mg_3(PO_4)_2$) and the metal oxide is a dry magnesium oxide powder.

12. The process of claim 9, further comprising:

transporting the first transport container and the second transport container to the drilling site having an associated drilling site mixing system;

transferring the non-aqueous solution from the first transport container or into a drilling string;

transferring a spacer into the drilling string;

transferring the metal oxide mixture from the second transport container or into the drilling string wherein the non-aqueous solution and the metal oxide mixture are isolated from each other by the spacer; and pumping the non-aqueous solution, the spacer and the metal oxide out through the end of the drilling string to form a lost circulation slurry exiting a bottom hole assembly of the drilling string.

13. The process of claim 9, wherein the silicate material is attapulgite clay, bentonite clay, sepiolite clay, or rock wool and the metal oxide is magnesium oxide.

14. The process of claim 9, wherein the non-aqueous solution, when placed in the transport container, has a reactivity rate and retains that reactivity rate up to at least one month in a pre-mixed state.

15. The process of claim 9, wherein the second container further includes the non-aqueous isomerized olefin-based fluid and the viscosifier.

16. A pre-mixed lost circulation treatment delivery system, comprising:

a mixing plant located away from a target drilling site to which a lost circulation treatment is deliverable, comprising:

a mixing chamber and associated pumps and conduit systems for mixing lost circulation materials therein;

a first transport container configured to be transported to a drilling site for transfer to a drilling string;

a base lost circulation mixture located within the first transport container, comprising a mixture of;

a metal salt;

a silicate material; and a viscosifier; and a second transport container having metal oxide located therein for transport to the drilling sit for transfer to the drilling string;.

17. The pre-mixed lost circulation treatment delivery system of claim 16, wherein the metal oxide is an aqueous magnesium oxide mixture.

18. The pre-mixed lost circulation treatment delivery system of claim 16, wherein the metal oxide is a dry magnesium oxide powder.

19. The pre-mixed lost circulation treatment delivery system of claim 17, wherein the metal salt is magnesium sulfate heptahydrate ($MgSO4 \cdot 7H_2O$), or magnesium phosphate ($Mg_3(PO_4)_2$), and the silicate material is attapulgite clay, that are mixed with water to form an aqueous base lost circulation mixture located within the first transport container.

20. The pre-mixed lost circulation treatment delivery system of claim 19, wherein:

the metal oxide is a dry magnesium oxide powder, the metal salt is magnesium chloride hexahydrate ($MgCl_2 \cdot 6H_2O$), the silicate material is attapulgite.

21. The pre-mixed lost circulation treatment delivery system of claim 16, wherein the base lost circulation mixture has a reactivity rate when placed in the first container and retains the reactivity rate up to at least one month while in the first transport container.

22. A pre-mixed lost circulation treatment delivery system, comprising:

a mixing plant located away from a target drilling site to which a lost circulation treatment is deliverable, comprising:

a mixing chamber and associated pumps and conduit systems for mixing lost circulation materials therein;

a first transport container configured to be delivered to a drilling site;

a base lost circulation mixture located within the first transport container, comprising a mixture of;

a metal salt;

a silicate material; and a viscosifier; and a second transport container having metal oxide located therein wherein:

the selected from the group consisting of: styrene-isoprene copolymers, hydrogenated styrene-isoprene block copolymers, styrene ethylene/propylene block copolymers, styrene isobutylene copolymers, styrene butadiene copolymers, polybutylene and polystyrene, polyethylene-propylene copolymers, include copolymers and block copolymers such as poly (styrene-co-isoprene), hydrogenated block-copoly(styrene/isoprene), block-copoly(styrene/ethylene/propylene), poly (styrene-co- isobutylene), copolymer(styrene-co-butadiene), polybutylene,polystyrene, copolymer (polyethylene-co-propylene), and combinations of two or more thereof, and the metal salt, the silicate material and the viscofier are mixed in a non-aqueous isomerized olefin-based fluid to form an non-aqueous base lost circulation mixture located within the first transport container.

23. The pre-mixed lost circulation treatment delivery system of claim 22, wherein the second container further includes the non-aqueous isomerized olefin-based fluid and the viscosifier.

* * * * *